United States Patent [19]

Hashemifard

[11] 4,387,510

[45] Jun. 14, 1983

[54] GARDEN CUTTING TOOL

[76] Inventor: Mirahmad Hashemifard, 3 Robin Hill Rd., Great Neck, N.Y. 11024

[21] Appl. No.: 316,773

[22] Filed: Oct. 30, 1981

[51] Int. Cl.[3] ..... B26B 3/00

[52] U.S. Cl. ..... 30/314; 30/309; 30/342; 30/344

[58] Field of Search ..... 30/314, 309, 344, 342, 30/340

[56] References Cited

U.S. PATENT DOCUMENTS 56,099 7/1866 Robinson ..... 30/342

392,041 10/1888 Lesson ..... 30/309

*Primary Examiner*—James L. Jones, Jr.

*Assistant Examiner*—J. T. Zatarga

*Attorney, Agent, or Firm*—Richard L. Miller

[57] ABSTRACT

A garden cutting tool is provided that cuts tree branches, bushes, plants, weeds and the like and consists of a blade, a neck having an arm affixed to the bottom of the blade, a sleeve having a central aperture, extending from the arm and a pair of rods diametrically extending vertically from the bottom of the sleeve, a handle having an extension that mates within the central aperture of the sleeve, the handle having a pair of apertures diametrically extending vertically at the base of the extension, whereby the rods go into the apertures and are bent at the bottom of the handle to keep the handle in a secure and stable position and a fastener placed horizontally through the sleeve of the neck and the extension of the handle to keep the handle in a secure and stable position.

6 Claims, 3 Drawing Figures

GARDEN CUTTING TOOL

BACKGROUND OF THE INVENTION

The instant invention relates generally to tools. More specifically, it relates to a garden cutting tool that can be used for cutting tree branches, bushes, plants, weeds and the like. It is a valuable tool to home owners, gardeners, tree and forestry workers.

SUMMARY OF THE INVENTION

A principle object of the present invention is to provide a garden cutting tool that is designed to increase the cutting power of the tool.

Another object is to provide a garden cutting tool that is designed to reduce the vibration of the blade to the user's hand, wrist, elbow and shoulder joints during cutting and chopping.

A further object is to provide a garden cutting tool that is safe to use and will decrease the chance of injury.

A still further object is to provide a garden cutting tool that is designed to keep the portions of the tool in stable and secure positions.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The figures on the drawing are briefly described as follows.

DESCRIPTION OF THE PREFERRED EMBODIMENT

Figure 1:
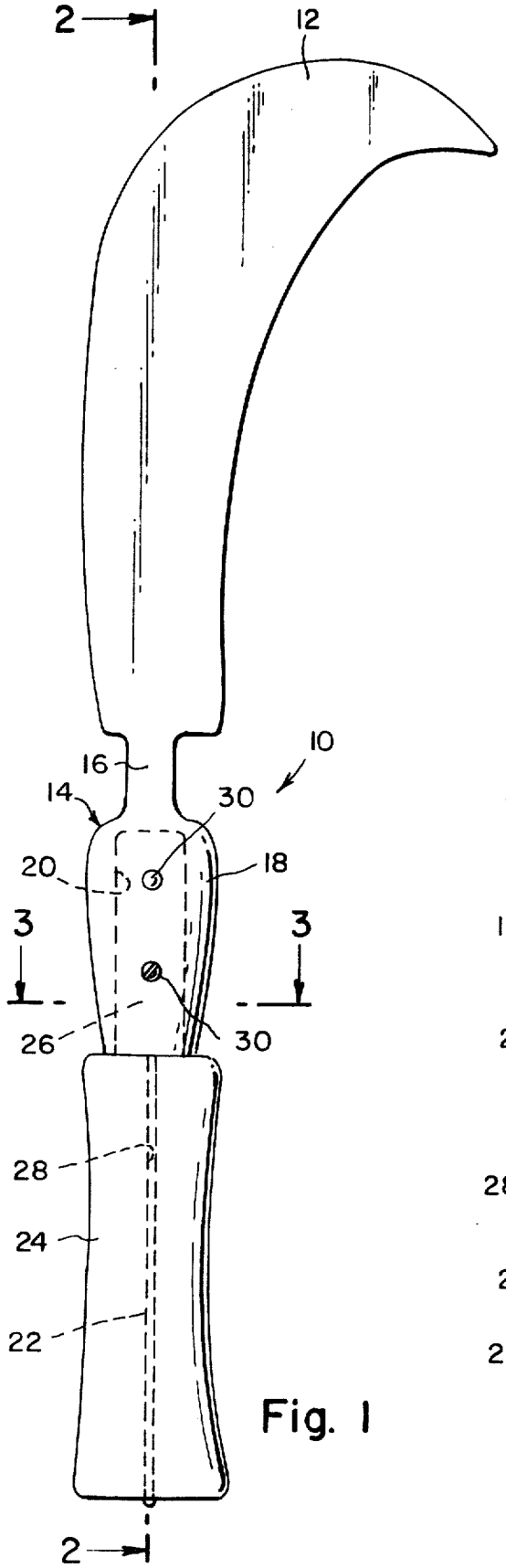
FIG. 1 is a front elevational view of the invention.
Figure 2:
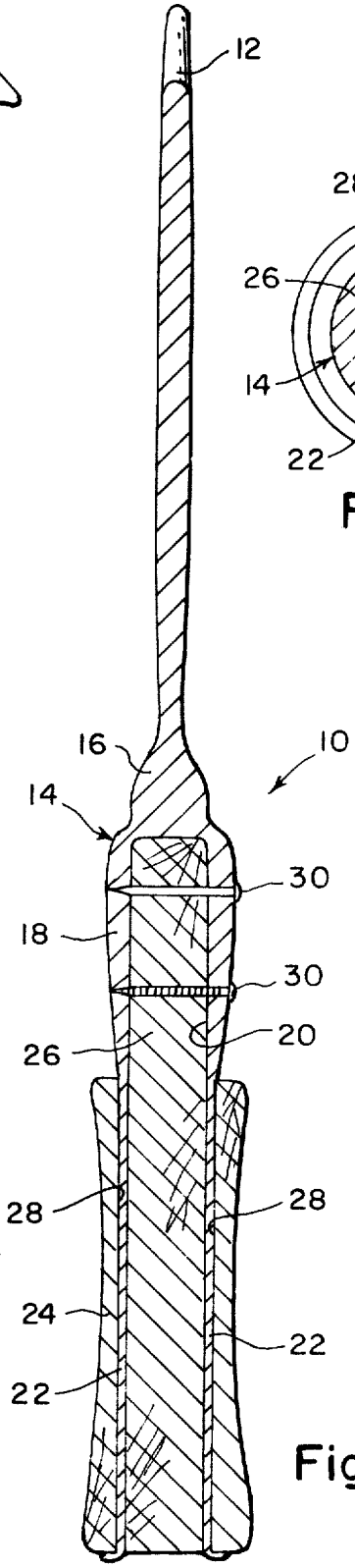
FIG. 2 is a cross sectional view taken on line 2—2 of FIG. 1.
Figure 3:
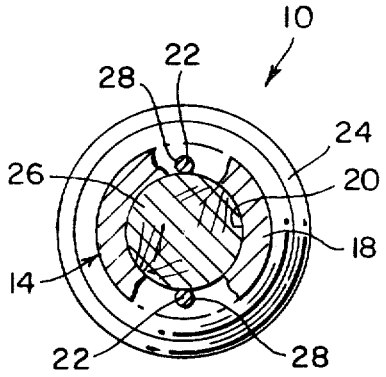
FIG. 3 is an enlarged cross sectional view taken on line 3—3 in FIG. 1 with a part broken away.

Referring now to the drawing in greater detail, the reference numeral 10 represents the garden cutting tool according to the present invention. The tool 10 has a blade 12 made of metal in the shape of an eagle's head and neck making it a modified sickle.

A neck 14 made of metal has an arm 16 affixed to the bottom of blade 12 and a sleeve 18 that extends from the arm 16. The sleeve 18 contains a central aperture 20 and a pair of rods 22, 22 diametrically extending vertically from the bottom of the sleeve 18.

A handle 24 made of wood has an extension 26 that mates within the central aperture 20 of the sleeve 18 and a pair of apertures 28, 28 diametrically extending vertically at the base of the extension 26. The rods 22, 22 go into the apertures 28,28 and bend at the bottom of the handle 24 to keep the handle 24 in a secure and stable position.

A fastener 30 is placed horizontally through the sleeve 18 of the neck 14 and the extension 26 of the handle 24 to keep the handle 24 in a secure and stable position. The fastener 30 can either be a nail or screw.

The blade 12 is modified in a way to improve the function and to increase the cutting ability of the tool 10. For example, the distal two thirds of the blade 12, except the last few centimeters, is thicker, wider and heavier in proportion to its proximal one third that is closer to the neck 14. There is also a slight modification of the curve of the blade 12 as seen in FIG. 1. The length of the blade 12 is increased and modification of its curve make it easier to catch the target when trimming the tree branches or chopping wood.

The neck 14 in the shape of a bottle is designed partly for protective reasons. The neck is reasonably long and will increase the distance between the person using the tool and the target which will decrease the chance of injury.

The neck 14 is a neutral zone with the heavier portion of the tool, the metal blade 12, distal to it and the lighter portion, the wooden handle 24, proximal to it with the result of an increase in cutting power of the tool.

The arm 16 and the hollow sleeve 18 embedding the extension 26 of the wood handle 24 helps to significantly reduce the transfer of the vibration of the blade 12 to the user's hand, wrist, elbow and shoulder joints during cutting and chopping of wood.

While certain novel features of this invention have been shown and described and are pointed out in the annexed claims, it will be understood that various omissions, substitutions and changes in the forms and details of the device illustrated and in its operation can be made by those skilled in the art with out departing from the spirit of the invention.

What is claimed is:

1. A garden cutting tool which comprises:

(a) a blade;

(b) a neck having an arm affixed to bottom of said blade, a sleeve having a central aperture, extending from said arm and a pair of rods diametrically extending vertically from bottom of said sleeve;

(c) a handle having an extension that mates within said central aperture of said sleeve, said handle having a pair of apertures diametrically extending vertically at base of said extension, whereby said rods go into said apertures and are bent at bottom of said handle to keep said handle in a secure and stable position; and (d) a fastener placed horizontally through said sleeve of said neck and said extension of said handle to keep said handle in a secure and stable position.

2. A garden cutting tool as recited in claim 1, in which said blade is made of metal and is a modified sickle in the shape of an eagle's head and neck.

3. A garden cutting tool as recited in claim 2, in which said neck is made of metal and is in the shape of a bottle.

4. A garden cutting tool as recited in claim 3, in which said handle is made of wood.

5. A garden cutting tool as recited in claim 4, in which said fastener is a nail.

6. A garden cutting tool as recited in claim 4, in which said fastener is a screw.

* * * * *